US006637622B1

(12) United States Patent
Robinson

(10) Patent No.: US 6,637,622 B1
(45) Date of Patent: Oct. 28, 2003

(54) CARD DISPENSER APPARATUS AND PROTECTIVE GUARD THEREFOR

(75) Inventor: Joseph D. Robinson, 1209 W. 159th St., Gardena, CA (US) 90247

(73) Assignees: Joseph D. Robinson, Gardena, CA (US); Henry M. Bissell, Los Angeles, CA (US)

( * ) Notice: Subject to any disclaimer, the term of this patent is extended or adjusted under 35 U.S.C. 154(b) by 51 days.

(21) Appl. No.: 10/017,332

(22) Filed: Dec. 13, 2001

Related U.S. Application Data

(60) Provisional application No. 60/255,703, filed on Dec. 18, 2000.

(51) Int. Cl.[7] ..... B65G 59/00

(52) U.S. Cl. ..... 221/268; 221/232

(58) Field of Search ..... 221/268, 45, 56, 221/270, 271, 232, 258, 267; 312/50, 61

(56) References Cited

U.S. PATENT DOCUMENTS 701,358 A 6/1902 Klepetar
2,288,870 A 7/1942 Weber et al.
4,711,371 A 12/1987 Harrigan

FOREIGN PATENT DOCUMENTS

FR 572837 6/1924

*Primary Examiner*—Kenneth W. Noland
(74) *Attorney, Agent, or Firm*—Bissell & Bissell; Henry M. Bissell; Henry M. Bissell, IV

(57) ABSTRACT

A combination card dealing shoe and protective guard plate is disclosed. An improved card follower device is also included for more effective control of the cards when the shoe is in use. The guard plate may be formed integrally with the shoe or it may be fabricated as a separate item for retrofitting attachment to an existing shoe. The plate is bifurcated and the two parts are joined by a hinge with a coil spring which urges the lower portion of the cover plate downward and inward to substantially cover the finger opening in the front panel of the shoe to conceal the card which is in position ready for dealing. The hinged portion of the cover plate has a projecting member defining an opening which is sufficient to give the dealer's thumb and/or finger access to the shoe without exposing the card that is being dealt, thus preventing one type of cheating by a dealer.

19 Claims, 4 Drawing Sheets

CARD DISPENSER APPARATUS AND PROTECTIVE GUARD THEREFOR

CROSS-REFERENCE TO RELATED APPLICATION

This application claims the benefit of U.S. Provisional Application No.: 60/255,703, filed Dec. 18, 2000.

BACKGROUND OF THE INVENTION

1. Field of the Invention

This invention relates generally to a playing card dispenser commonly referred to as a "shoe" and, more particularly, to a dispenser guard apparatus which, when in position in combination with the shoe, substantially inhibits the ability of the dealer to cheat by dealing the second card or cards other than the top one. It does so by concealing from view of the dealer the next card in the shoe and also blocks the manipulation by the dealer of that card in order to deal the card behind it. The dispenser device also includes an improved card follower or "pusher" to bias the cards toward the dispensing position.

2. Description of the Related Art

Both the gaming industry and individual card gamers may employ playing card dispensers, commonly known as "shoes," in order to facilitate the dealing of the cards in an honest and straightforward manner. In the card game of blackjack, for example, a shoe is stocked with one or more decks of shuffled playing cards. Conventionally, the front panel of the shoe is provided with an opening extending upward from the bottom through which the back of the next card be dealt is exposed. To access this card, the dealer slides his thumb or fingers downwardly along this opening with the result that the card is moved downward and out through a slot at the bottom of the shoe in a face down position.

Because of the opening in the front panel, the back side of the card which is to be dealt next is exposed. Thus, if a player had previously marked that card he would be able to see the mark before he placed his bet and before the card was dealt. Likewise, if a dealer had previously marked a card or knew of the marking, the dealer also would be able to see the marked card prior to it being dealt. Because of this arrangement, a skillful and unscrupulous dealer could lift the marked card to save it for a "shill" and deal the card immediately behind the marked card.

Any cheating by a dealer in this manner gives a bad name to the casino or other gaming facility. Accordingly, efforts have been made, to develop apparatus which render misdealing from a shoe impossible.

Apparatus has been developed in the prior art which serves to cover the front panel opening with a flexible closure so that the cards in the shoe, particularly the next card to be dealt, cannot be seen by the dealer or players. One such arrangement is the subject of U.S. Pat. No. 4,711,371 of Harrigan wherein a plate to be placed over the front panel of the shoe has an opening essentially aligned with the front panel opening. The plate has a flexible closure for the opening therein which may be parted along a vertical axis to provide the dealer's fingers access to the next card to be dealt. The flexible closure includes a plurality of inwardly projecting strands extending from the right and left perimeter of the opening in the plate, somewhat resembling a paint brush, in order to conceal the top playing card in the shoe. This arrangement is undesirably cumbersome, is subject to wear and adds significantly to the cost of the shoe on which it is mounted.

Klepetar U.S. Pat. No. 701,358 and Weber et al. U.S. Pat. No. 2,288,870 disclose different apparatus for delivering or vending pasteboard tickets which are oriented in the delivery apparatus in stacks. The Klepetar patent has an arrangement for preventing a dispensed ticket from being taken back into the apparatus. The same mechanism is said to prevent fraudulent extraction of tickets. The Weber et al. apparatus is said to obviate the problem of jamming in the delivery of individual tickets from the stack of tickets within the machine. It is not seen how either one of these arrangements could be readily adapted to the card dealing apparatus used in the gaming industry.

French patent 572.837 was cited as a reference of record in the Harrigan patent. However, no translation is available and therefore applicant is unable to discern any possible relevance to the present invention.

Conventional playing-card dealing shoes incorporate an arrangement to move the deck of cards in the direction of the front panel opening so that the next card dealt is always accessible to the dealer, merely upon his putting his fingers through the opening to access the card. In a typical dealer shoe, the bottom of the card box is slanted downwardly toward the front opening and a follower, not shown in the Harrigan patent, is provided to push the deck of cards downward along the slanted bottom and forward toward the opening. Typically the follower comprises a frame or housing having a slanted forward wall. Within the housing, extending laterally thereof between the side walls of this housing is a single roller having outwardly projecting bands which engage the floor of the shoe. This roller is mounted near the rear of the housing in such a manner that the housing pivots forwardly and downwardly so that its front wall bottom edge slides along the floor of the shoe. The housing is generally constructed of a lightweight material, such as plastic or aluminum, but the roller is made of steel or some other heavier material. The weight of this roller is what pushes the follower, and the cards in front of it, down the incline bottom toward the front wall opening of the shoe.

With repeated use of the dealer shoe, the forward edge of the follower housing scrapes along the bottom wall of the shoe and eventually develops roughness and surface irregularities which on occasion cause the follower to hang up or stick in a retracted position, such; that the playing cards are no longer presented adjacent the opening in the front wall. This is an undesirable problem, for which the preferred arrangement of the present invention provides a solution.

SUMMARY OF THE INVENTION

In brief, particular arrangements in accordance with the present invention comprise a plate for fitting over the front panel of a conventional card dealing shoe to preclude the dealer or players from viewing the top card in the shoe.

The plate is bifurcated into upper and lower sections which are joined by a hinge in a manner which permits the lower section to be raised somewhat so that the dealer's fingers can access the opening in the front panel of the shoe without exposing the top card prior to its withdrawal to be dealt. The upper section is provided with an adhesive backing or other means which permit the upper plate to be affixed to the corresponding portion of the front panel of the shoe.

For convenience in raising the lower portion of the plate to provide access to the next card in the shoe, the lower portion is shaped, as by molding, with a projection which extends slightly outward from the surface of the plate. This projection is shaped to define a short channel through the plate along which the dealer's thumb and/or fingers may access the top card through the opening in the front panel of the shoe. The shape of the projection is such that insertion of the dealer's thumb into the channel automatically raises the lower portion of the plate, pivoting about the hinge, just enough to gain access to the card to be dealt without exposing the card to view. The cards within the shoe are biased toward the front panel of the shoe by a card follower device fashioned in accordance with an aspect of the invention.

In accordance with another aspect of the invention, the hinge is formed by a small plastic pin or dowel which is inserted through the gudgeon elements of the upper and lower portions of the plate. Preferably the pin is press fit into the two end gudgeons of the assembly.

In accordance with still another aspect of the invention, a spring is provided in the hinge mechanism to bias the lower portion of the plate toward its closed position. This provides greater assurance that the lower portion is not inadvertently raised to the point where the top card in the shoe is exposed to view. In one preferred embodiment, this spring is formed of spring wire having two members extending in opposite directions from a central coiled portion that encircles the pivot pin in the center of the hinge. Small holes are provided in each of the upper and lower portions of the plate for receiving bent terminal ends of the spring, holding them in place so that the extensions from the central coiled core of the spring apply forces against the upper and lower portions of the plate to urge the lower portion downward toward the lower portion of the shoe front panel and maintain the opening in the panel covered.

The follower device of the present invention avoids the disadvantages described hereinabove with respect to follower devices of the prior art by having a pair of steel rollers extending transversely of the housing, the ends of which are supported for rotation in bearings within the side walls of the housing. These rollers are on opposite sides of the lateral and mid-plane of the follower housing and comprise a weight approximately equal to the weight of the single roller of the prior art follower device so that the desired result of biasing the cards toward and up to the front panel opening is achieved. However, the occasional hangups of the follower device of the prior art are avoided by the follower of the invention by virtue of the fact that there is no point or line of contact between the follower housing and the floor of the shoe. Each roller is provided with a pair of "tires" on opposite sides of the roller midpoint. Thus, the follower device is supported at four points by these "tires" on the rollers in a stable arrangement which avoids any sliding friction with the bottom of the shoe. These "tires" may advantageously comprise standard O-rings of suitable dimension and are mounted and held in position on the rollers by circumferential depressions in the roller surfaces.

In addition to the bifurcated plate assembly described hereinabove, the invention also encompasses the combination of such a plate and a shoe. In such combination, the front panel of the shoe might be integrally formed with the upper portion of the plate. Alternatively, the upper portion of the plate would be attached to the shoe by conventional means, such as an adhesive-backed insert, glue, cement, screws, nails, string, rubber bands, to name a few, or any equivalent thereof. In fact, the bifurcated plate could take the place of the front panel of the shoe in certain configurations where the upper part of the plate serves to retain the cards in the shoe while permitting the top card to be removed during access as the lower portion is raised.

BRIEF DESCRIPTION OF THE DRAWINGS

A better understanding of the present invention may be realized from a consideration of the following detailed description, taken in conjunction with the accompanying drawings, in which.

4

DESCRIPTION OF THE PREFERRED EMBODIMENTS

Figure 1:
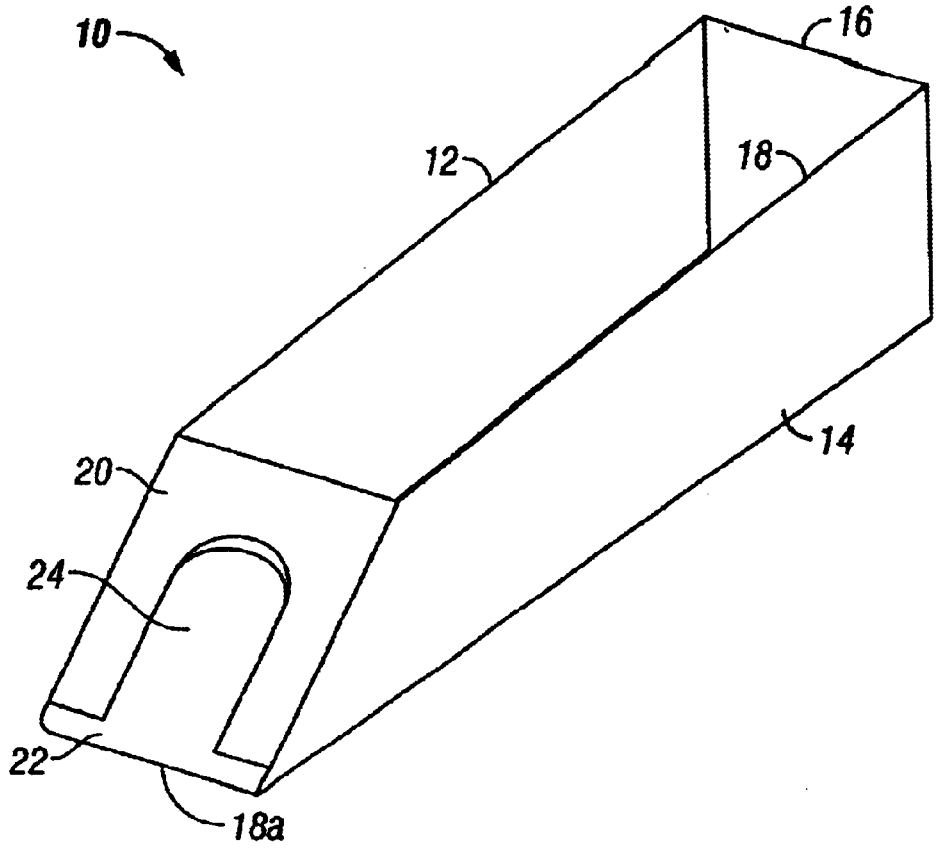
FIG. 1 is a schematic perspective view of a conventional shoe as commonly used in card playing establishments.

The conventional card dealing shoe 10 resembles an open-topped box, having sides 12 and 14, a rear end 16, a bottom 18, and a front panel 20. The construction of the front end is such that the panel is slanted toward the rear. The bottom is also slanted, but less so than the front panel, with a hollow space underneath. The card dealing shoe 10 is also conventionally provided with a follower (not shown) which has a weighted roller and a forward face slanted at approximately the angle of the front panel so as to propel the deck(s) of cards forwardly with each card being raised very slightly relative to the card ahead of it. There is a slot 22 at the bottom of the front panel just above the step 18*a* which is a projection at the bottom of the shoe.

The front panel defines a horseshoe-shaped opening 24 which provides the dealer's thumb and/or fingers access to the top card of the deck(s) within the shoe 10.

Figure 2:
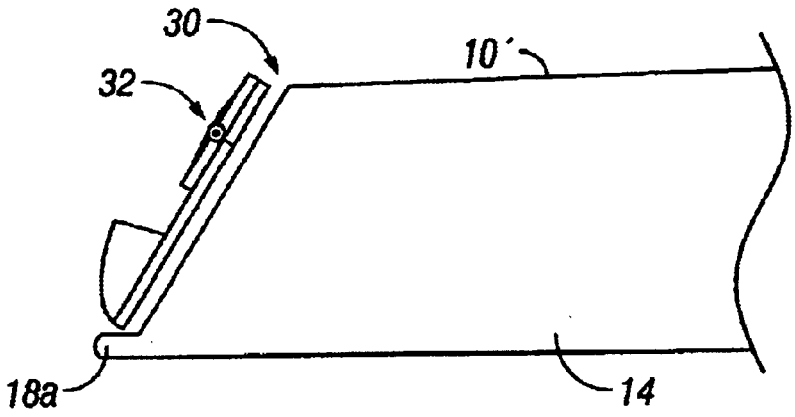
FIG. 2 is a schematic side view showing the protective guard plate of the present invention juxtaposed adjacent the front portion of a card dealing shoe to provide a combination shoe and protective guard plate.
Figure 2A:
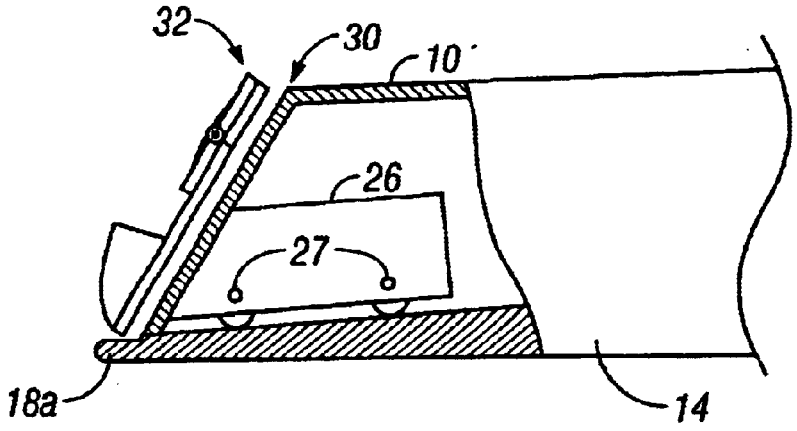
FIG. 2A is a schematic side view like that of FIG. 2 but with one side of the shoe broken away to show the card follower of the invention therein.
Figure 3:
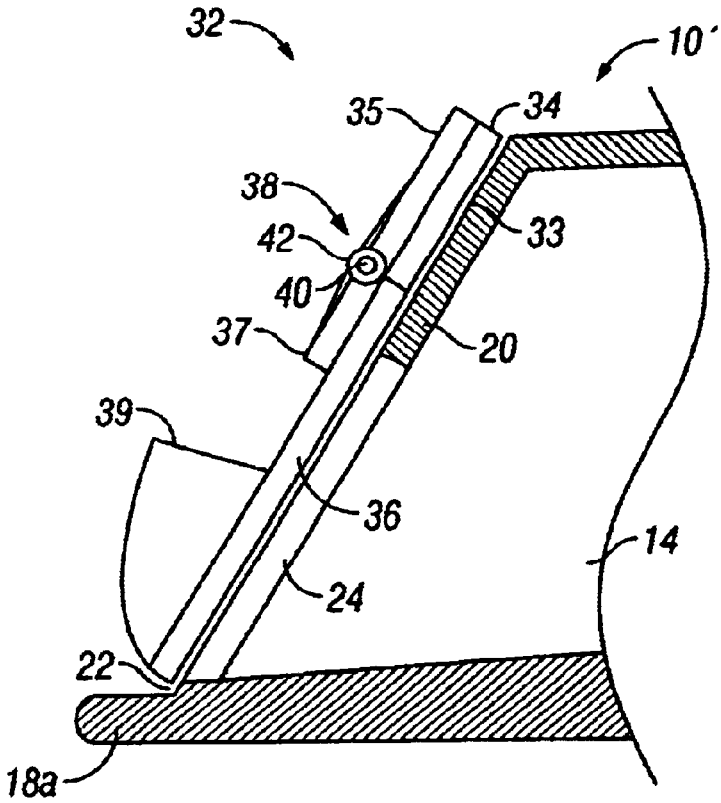
FIG. 3 is a larger view of the plate of FIG. 2 shown in combination with a shoe.
Figure 4:
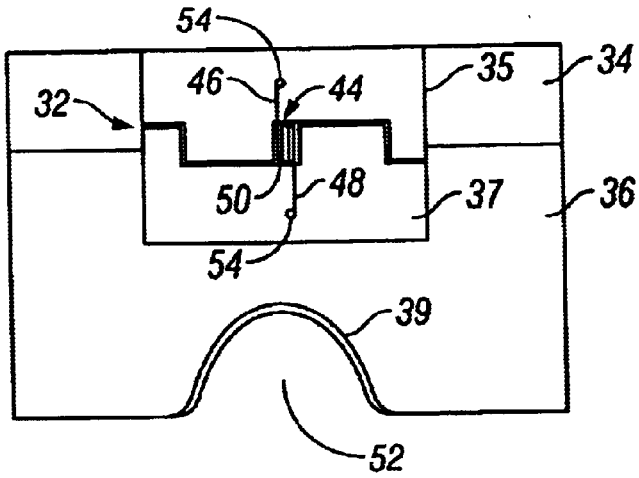
FIG. 4 is a schematic front view of the protective plate of FIGS. 2 and 3.
Figure 5:
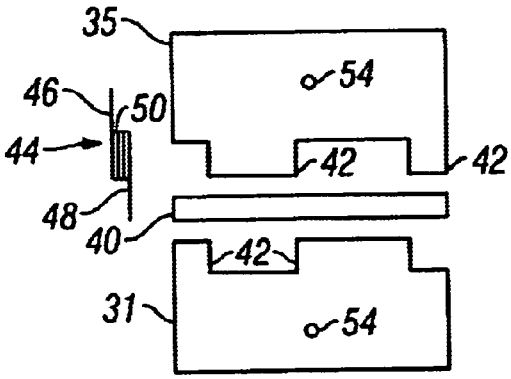
FIG. 5 is a schematic exploded view showing the parts of the protective plate of the invention.
Figure 5A:
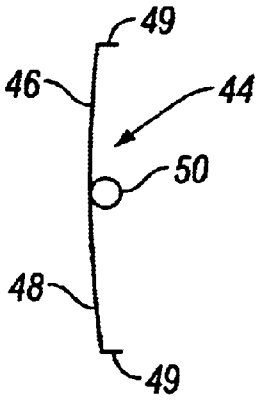
FIG. 5A is side view of the spring shown as a component element in FIG. 5.

FIGS. 2, 2A and 3 show a combination shoe, card follower 26 and guard plate 30 in accordance with the invention comprising a card dealing shoe 10' in combination with a guard plate 32. The guard plate 32 is shown in enlarged detail in FIG. 3 as comprising an upper portion 34 and lower portion 36. The portions 34 and 36 are separate from each other but are joined respectively to leaves or wings 35, 37 of a hinge 38 having a central pin 40 extending within gudgeons 42. The hinge assembly includes a coiled wire spring 44 (FIG. 4) having separate terminal or end members 46, 48 and a central coil portion 50. The terminal portions 46 and 48 of the spring 44 are bent inwardly at their tips 49 (FIG. 5A) for insertion in small openings 54 in the respective upper and lower leaves 35, 37 of the hinge 38.

The upper portion 34 of the guard plate 32 has an adhesive-backed pad 33 for attachment to the front panel 20 of a card dealing shoe. The lower portion 36 is provided with an outwardly projecting member 39, preferably molded from the portion 36, to define an opening or channel 52 for thumb access to the card in position at the opening 24 of the front panel 20. The member 39 defines an opening 52 which is substantially smaller than the opening 24 in the front panel 20, thus effectively concealing the top card of the deck which would otherwise be visible through the opening 24.

Figure 6:
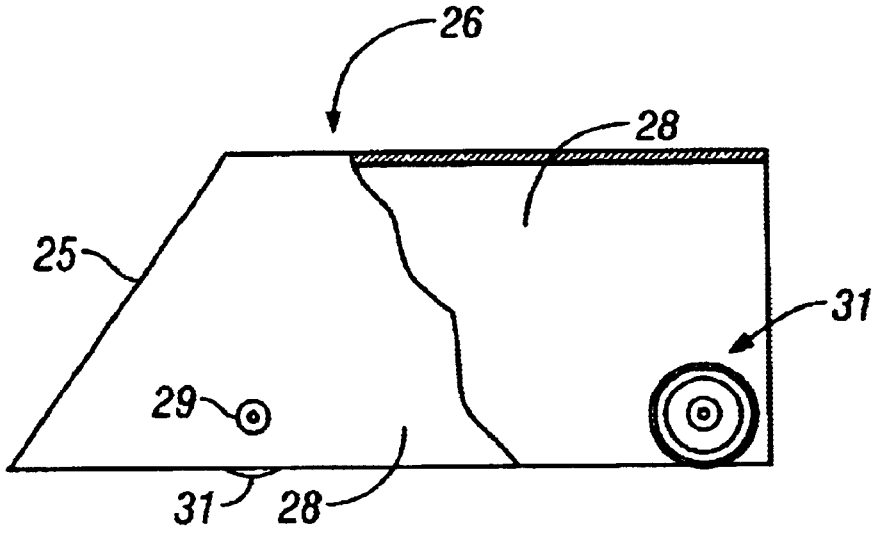
FIG. 6 is a side view, partially broken away, of the card follower device of the invention.

The card follower device (FIGS. 2A and 6) is essentially a box having open bottom and rear. The forward panel 25 is slanted in order to push the cards ahead of the card follower device 26 as cards being dealt are accessed and removed through the front opening of the shoe. The forward panel 25 is preferably slanted at the same angle as the front panel of the box.

Figure 7:
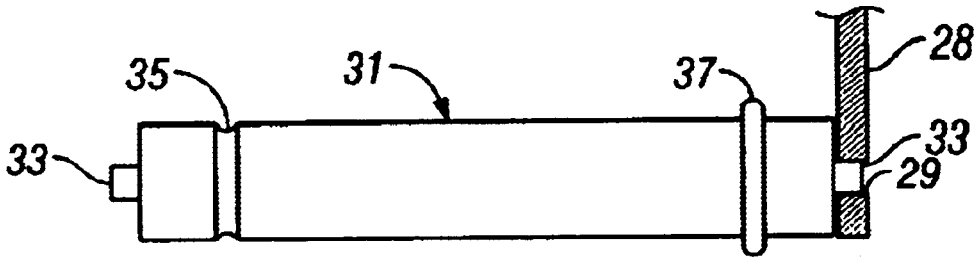
FIG. 7 is a view of one of the rollers of the card follower device of FIG. 6.

Extending between side walls 28 of the follower device and mounted in bearings 29 installed therein is a pair of rollers 31 which extend transversely of the follower device 26. One such roller is shown in FIG. 7 installed within a portion of one side wall 28. Each roller 31 is formed with a pair of circumferential depressions 35 which receive and retain a small rubber "tire" 37. This "tire" 37 may advantageously comprise a polymeric O-ring of suitable dimensions. At opposite ends of each roller 31 are axially extending axle portions 33 which support the roller 31 within the bearings 29.

These rollers 31 together match the weight of the single roller of card follower devices presently employed in card dealing shoes currently in use. Thus, they exert the same forward force biasing the cards toward the front opening of the shoe but avoid one of the problems encountered in current equipment wherein the nose of the follower device occasionally hangs up on the floor of the card dealing, shoe. In the follower device of the present invention, the only contact between the floor of the shoe and the card follower device comes from the "tires" 37 rolling along the bottom of the shoe. Friction is eliminated.

Thus it will be seen that different arrangements in accordance with the invention are particularly effective in achieving the purpose for which they are intended. An improved card follower device avoids problems encountered with prior art devices. A card dealing shoe incorporating a protective guard as shown and described effectively prevents cheating by the dealer in the selection of the next card to be dealt. A protective guard plate of the invention is preferably fabricated completely of plastic, except possibly for the central spring. The spring is not necessary and the protective guard plate could be used effectively without it. The guard plate is adapted for retrofitting existing card dealing shoes to perform as effectively as a newly manufactured combination unit. The guard plate is simple in design, effective in use, low in cost of manufacture, and has no parts which are vulnerable to wear, as is the case with similar devices now in use.

Although there have been described hereinabove various specific arrangements of a CARD DISPENSER APPARATUS AND PROTECTIVE GUARD THEREFOR in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A playing card dispenser having a guard apparatus for restricting access to cards within the dispenser, said dispenser comprising:

a box open at the top for receiving a plurality of playing cards in an orientation to be dispensed from the box in serial fashion;

a slanted forward end panel defining an opening adjacent the lower side thereof for permitting individual cards to be drawn from the box;

a bottom of the box slanted downward toward said forward end panel for supporting said plurality of playing cards;

said opening having a shape comprising a slit along the bottom of the panel for passing a card from the interior of the box to the exterior and extending upward from the slit to permit a dealer's thumb and/or fingers to access the next card adjacent the front panel; and said guard apparatus comprising a bifurcated plate having upper and lower sections joined by a hinge for permitting the lower section to be raised to a position where a dealer's fingers can access the opening defined in said front panel without exposing the forward-most card prior to its withdrawal from the box.

2. The apparatus of claim 1 wherein the lower section includes a hood portion extending outwardly from at least a portion of the periphery of said opening.

3. The apparatus of claim wherein said hood portion is shaped as part of said lower section to block the view of game players from the next card to be dealt.

4. The apparatus of claim 2 wherein said hood portion is shaped to facilitate raising of the lower portion about the hinge as a dealer's fingers are inserted to deal the next card.

5. The apparatus of claim 1 wherein said guard apparatus is integrally formed with said box as the forward end panel of the playing card dispenser.

6. The apparatus of claim 1 wherein the upper section of the hinged plate is affixed to the forward end panel at the upper portion thereof.

7. The apparatus of claim 6 wherein the upper section of the hinged plate is adhesively attached to the forward end panel of the box.

8. The apparatus of claim 1 wherein the slanted bottom of the box extends beyond the forward end panel to form a ledge for supporting a card as it is withdrawn from the box.

9. The apparatus of claim 1 further including a card follower device for propelling the cards downward and forward along the slanted bottom toward the forward end panel, said card follower device having a plurality of rotatable members mounted to support said device on the slanted bottom of the playing card dispenser.

10. The card follower device of claim 9 wherein said rotatable members comprise weighted rollers having extending axle portions mounted in bearings installed in side walls of said device.

11. The card follower device of claim 10 wherein each roller includes a pair of circumferential recesses located on opposite sides of the midpoint of the roller and a pair of elastomeric rings positioned in said recesses for bearing against the slanted floor of the dispenser.

12. The card follower device of claim 11 wherein said rings project below the bottoms of the side walls to support the card follower device above and out of frictional contact with the bottom of the box.

13. The card follower device of claim 11 wherein said elastomeric rings comprise O-rings.

14. The card follower device of claim 10 further including a slanted forward panel extending transversely between said side walls, said forward panel being mounted at an angle relative to the slanted bottom of the box which approximates the angle of the slanted forward end panel of the box.

15. A guard apparatus for use with a playing card dispenser, which dispenser has a slanted forward end panel defining an opening adjacent the lower side thereof for permitting restricted access to a dealer's thumb and/or fingers to draw individual cards within said dispenser, said guard apparatus comprising:

a bifurcated plate having upper and lower sections joined by a hinge for permitting the lower section to be raised to a position where a dealer's fingers can access the opening defined in said front panel without exposing the forward-most card prior to its withdrawal from the box.

16. The apparatus of claim 15 wherein the lower section defines an opening and includes a hood portion extending outwardly from at least a portion of the periphery of said lower section opening.

17. The apparatus of claim 16 wherein said hood portion is shaped as part of said lower section to block the view of game players from the next card to be dealt.

18. The apparatus of claim 16 wherein said hood portion is shaped to facilitate raising of the lower section about the hinge as a dealer's fingers are inserted to draw the next card.

19. The apparatus of claim 15 wherein the upper section of said bifurcated plate is equipped along its rearward surface with means for adhesively attaching the bifurcated plate upper section to said slanted forward end panel.

* * * * *